US005878847A

United States Patent [19]

Mustalahti et al.

[11] Patent Number: 5,878,847

[45] Date of Patent: Mar. 9, 1999

[54] ARRANGEMENT FOR FIXING AN ELEVATOR ROPE

[75] Inventors: Jorma Mustalahti, Hyvinkää ; Esko Aulanko, Kerava; Harri Hakala, Hyvinkää, all of Finland

[73] Assignee: Kone Oy, Helsinki, Finland

[21] Appl. No.: 809,489

[22] PCT Filed: Sep. 27, 1995

[86] PCT No.: PCT/FI95/00530

§ 371 Date: Jun. 19, 1997

§ 102(e) Date: Jun. 19, 1997

[87] PCT Pub. No.: WO96/09978

PCT Pub. Date: Apr. 4, 1996

[30] Foreign Application Priority Data

Sep. 27, 1994 [FI] Finland ..... 944475

[51] Int. Cl.[6] ..... B66B 7/02

[52] U.S. Cl. ..... 187/406; 187/266

[58] Field of Search ..... 187/406, 407, 187/408, 266, 256, 411

[56] References Cited

U.S. PATENT DOCUMENTS 3,845,842 11/1974 Johnson ..... 187/408

*Primary Examiner*—Kenneth Noland
*Assistant Examiner*—Khoi H. Tran
*Attorney, Agent, or Firm*—Birch, Stewart, Kolasch & Birch, LLP

[57] ABSTRACT

According to the invention, at least one end of the elevator ropes (8) is fixed to a guide rail (4,7) of the elevator. According to an embodiment of the invention, the whole elevator is so suspended by its ropes (8) that all vertical forces are transmitted by the guide rails (4 . . . 7) to the bottom (27) of the shaft (1). The invention provides the advantages that the elevator is easy to install and that the ical forces are transmitted by the guide rails (4 . . . 7) to the bottom (27) of the shaft (1), permitting a lighter construction of shaft walls.

2 Claims, 2 Drawing Sheets

ARRANGEMENT FOR FIXING AN ELEVATOR ROPE

BACKGROUND OF THE INVENTION

The present invention relates to an arrangement for fixing the elevator rope in an elevator and to an arrangement for the use of guide rails as supporting elements of an elevator and its equipment.

In traction sheave elevators, the ends of the elevator ropes are conventionally fixed to the elevator shaft or to anchorages in a machine room in the upper part of the elevator shaft. The other ends of the elevator ropes are usally fixed by means of springing elements. Similarly, the diverting pulleys of an elevator are typically mounted in the elevator shaft or in the machine room, but diverting pulleys mounted on an elevator guide rail are also known.

Previously known solutions for the fixing of elevator ropes have the drawback that the elevator ropes require a strong anchorage in the building and that the position of the anchorage in relation to the building, elevator, elevator shaft, elevator machinery and diverting pulleys must be closely defined. Therefore, fixing the elevator ropes by known techniques requires a long installation time because a holding element for a rope fixing element has to be installed first in the elevator shaft or machine room.

SUMMARY OF THE INVENTION

The object of the present invention is to produce a new arrangement for the fixing of elevator ropes, designed to facilitate the installation of elevator ropes and to reduce the installation time. Another object of the invention is to eliminate the need for mounting bases for elevator rope fixing elements mounted in the elevator shaft or in the machine room. A further object of the invention is to avoid the transmission of vertical forces of the elevator ropes to the building or to the shaft walls.

The invention has the advantage that the installation time and the total installation costs of the elevator are reduced. To achieve these advantages, the elevator guide rails are first fixed to the walls of the elevator shaft in a manner known in itself, e.g. to C-profile beams. Each end of the elevator rope is fixed to one of the guide rails. The guide rail ends can be provided with holes for the mounting of rope fixtures at the factory. The elevator machinery is mounted on one guide rail, and likewise a diverting pulley, so that all vertical forces of the elevator are transmitted via the guide rails to the bottom of the shaft. Therefore, the vertical forces impose no strain on the walls of the building. Thus, the exact position of the elevator is determined by the guide rails and the elevator imposes no vertical pressure on the building. As the elevator ropes are fixed to a guide rail, it follows that no mounting bases for rope fixing elements need to be installed, thus shortening the installation time.

The weight of elevator ropes fixed to a guide rail, that of the elevator car and counterweight supported by the ropes as well as the weight of an elevator machinery supported by a guide rail, in other words, almost all of the weight of the whole hoisting function is transmitted by the guide rails to the bottom of the elevator shaft. The transmission of internal forces of the hoisting function through the shaft bottom or walls is avoided. An example of a disadvantageous solution avoided by the invention is an elevator in which the elevator ropes apply an upward pull to an elevator machinery mounted on the shaft bottom and to the shaft bottom itself. The invention also obviates the labor and costs resulting from anchoring the machinery in the building.

BRIEF DESCRIPTION OF THE DRAWINGS

In the following, an embodiment of the invention is described by the aid of drawings, in which.

DESCRIPTION OF THE PREFERRED EMBODIMENT

Figure 1:
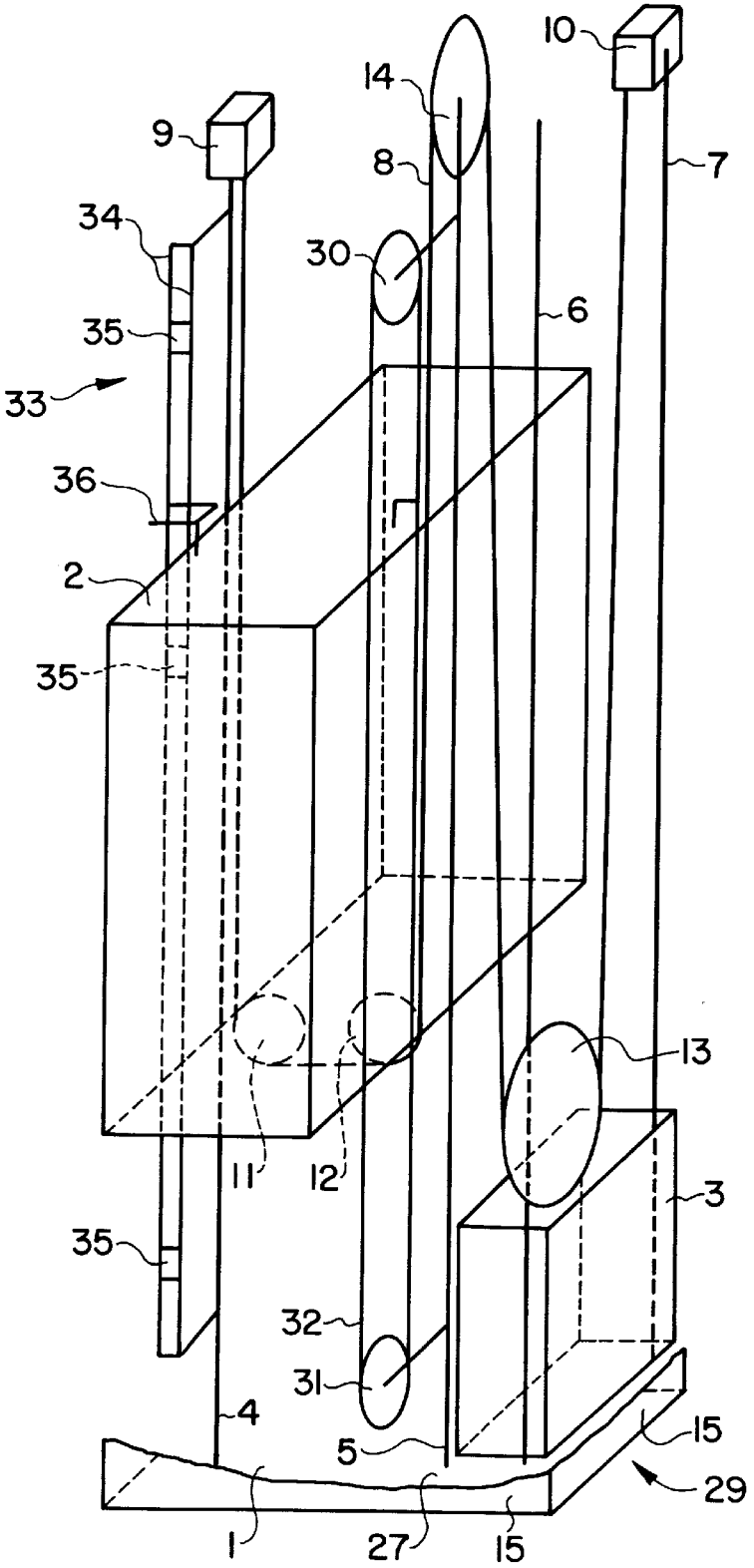
FIG. 1 presents a diagrammatic view of an elevator with ropes mounted according to the invention.

In FIG. 1, the elevator car 2 of an elevator 29 moves vertically along a first elevator guide rail 4 and a second elevator guide rail 5 mounted in an elevator shaft 1. The counterweight 3 also moves vertically along a first counterweight guide rail 6 and a second counterweight guide rail 7 mounted in the shaft. For the sake of readability of the illustration, the walls of the elevator shaft are not shown except for the bottom parts of two walls 15. The elevator 2 and the counterweight 3 are supported and moved by means of an elevator rope 8. The elevator rope 8 has two ends and consists of a number of parallel ropes (FIG. 3). The elevator machinery 14 is mounted on the top end of one 5 of the guide rails. The motor of the elevator machinery is a disc-type motor and the machinery is provided with a traction sheave. The elevator machinery is not described here in detail because it is outside the scope of this invention. One of the two ends of the elevator rope is fixed to the top end of the first elevator guide rail 4 by means of a rope fixing element 9, from where the elevator rope is passed to the traction sheave of the elevator machinery 14 mounted on the top end of the second elevator guide rail 5. From here, the elevator rope is passed to the diverting pulley 13 of the counterweight 3 and then up to a second rope fixing element 10 mounted on the top end of the second counterweight guide rail 7, by means of which element 10 the other end of the elevator rope is fixed to the guide rail 7. This second rope fixing element 10 may be identical with the first rope fixing element 9 illustrated by FIG. 2, but it can also be implemented without using springing elements to fix the elevator ropes.

As the ropes and machinery of the elevator are mounted on the guide rails as described above, the vertical forces of the elevator are transmitted by the guide rails to the bottom 27 of the shaft 1.

Mounted on the guide rails are also known auxiliary pieces of equipment, such as an overspeed governor 30, which is fixed to guide rail 5, and a device 33 for determining the elevator position, fixed to guide rail 4. The overspeed governor 30 comprises a closed rope loop 32, one end of which is passed around a diverting pulley 31 mounted it the lower part of guide rail 5. As is known, the overspeed governor causes the elevator to stop e.g. by means of a safety gear. The position indicating device 33 of the elevator comprises two thin ropes 34 fixed by their top and bottom ends to guide rail 4 by means of brackets. Fixed between the ropes 34 are metal plates 35 that indicate the elevator position as a sensing element 36 moving with the elevator 29 passes them.

FIG. 1 illustrates only one possible arrangement for fixing the elevator rope according to the invention. The elevator rope fixing arrangement of the invention can also be implemented by fixing the elevator rope to one of the guide rails and the elevator machinery to the lower end of the other one.

Figure 2:
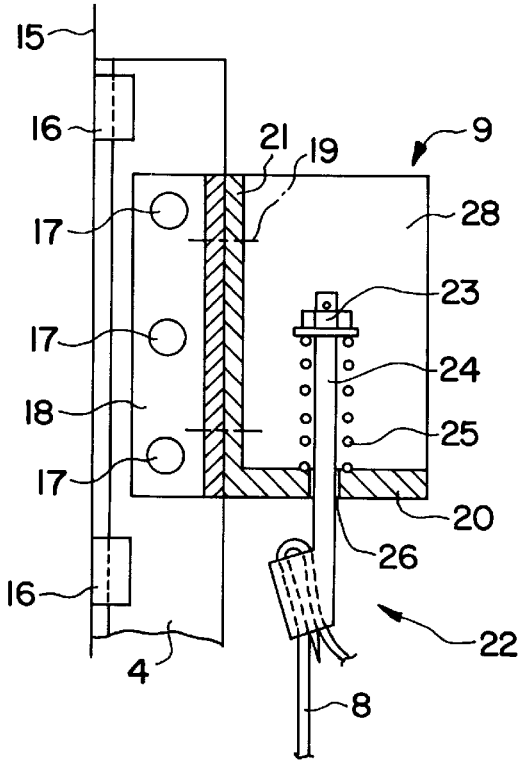
FIG. 2 presents a rope fixing element in cross-section.
Figure 3:
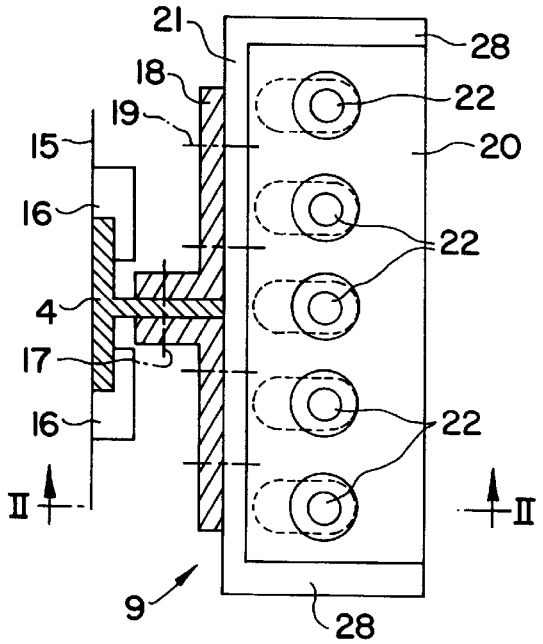
FIG. 3 presents a rope fixing element in top view.

FIG. 2 shows an elevator rope fixing element 9 sectioned in a vertical direction. The fixing element has a shape resembling a box with its front and top sides open. The frame of the fixing element consists of a bottom plate 20, a back plate 21 and two side plates 28 joined together. The bottom plate 20 is provided with a number of holes 26 corresponding to the number of elevator ropes, with a rope supporting element 22 passed through each hole. The rope supporting element 22 consists of a boltlike body 24 with a nut 23 and washer on its upper end. Between the washer and plate 20 is a springing element, preferably a helical spring 25. The lower end of the supporting element is provided with a conical hole in which a loop of the elevator rope 8 is formed, and the elevator rope is anchored in the conical hole by this loop by means of an expander bolt. Thus, each elevator rope is supported on the bottom plate 20 by a spring. Fixed with screws 19 to the back plate 21 are two mounting flanges 18, by which the whole fixing element 9 is attached to the guide rail 4 by means of other screws 17.

FIG. 3 presents the fixing element as seen from above. The guide rail 4 is fixed to the wall 15 of the elevator shaft by means of rail clips 16. The rail clips 16 permit vertical rail movement. Line II—II represents the section shown in FIG. 2.

It is obvious to a person skilled in the art that the embodiments of the invention are not restricted to the applications described, but that they may instead be varied in the scope of the following claims.

We claim:

1. Arrangement for fixing the elevator rope in an elevator comprising an elevator car, an elevator counterweight, elevator guide rails, counterweight guide rails, an elevator machinery, an elevator car rope having two ends at least one of which is fixed to one of the guide rails of the elevator or counterweight, and at least one diverting pulley, by means of which the elevator car is moved vertically in an elevator shaft, characterized in that the elevator rope fixed to a guide rail is driven by the elevator machinery which is also mounted on one of said guide rails.

2. Arrangement for using a guide rail as a supporting element of an elevator comprising an elevator car, an elevator counterweight (3), elevator guide rails, counterweight guide rails, an elevator machinery, an elevator rope (8) and at least one diverting pulley, by means of which the elevator car is moved vertically in an elevator shaft, and auxiliary equipment of the elevator, characterized in that the elevator (2) together with its equipment is suspended on the guide rails by fixing both ends of the elevator rope, the elevator machinery and the auxliary equipment of the elevator each to one of the guide rails of the elevator or counterweight.

* * * * *